US010676321B2

(12) United States Patent
Wang

(10) Patent No.: US 10,676,321 B2
(45) Date of Patent: Jun. 9, 2020

(54) MAINTENANCE SAFETY DEVICE FOR ELEVATOR AND A OPERATION METHOD THEREOF

(71) Applicant: Otis Elevator Company, Farmington, CT (US)

(72) Inventor: Bin Wang, Tianjin (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 378 days.

(21) Appl. No.: 15/615,431

(22) Filed: Jun. 6, 2017

(65) Prior Publication Data

US 2017/0355569 A1 Dec. 14, 2017

(30) Foreign Application Priority Data

Jun. 8, 2016 (CN) ..... 2016 1 0400010

(51) Int. Cl.

| | |
|---|---|
| ***B66B 13/24*** | (2006.01) |
| ***B66B 5/00*** | (2006.01) |
| ***B66B 13/16*** | (2006.01) |
| ***B66B 5/02*** | (2006.01) |
| ***B66B 13/14*** | (2006.01) |
| *B66B 1/26* | (2006.01) |

(52) U.S. Cl.

CPC ..... *B66B 13/245* (2013.01); *B66B 5/0031* (2013.01); *B66B 5/0062* (2013.01); *B66B 5/027* (2013.01); *B66B 13/14* (2013.01); *B66B 13/16* (2013.01); *B66B 1/26* (2013.01); *B66B 5/005* (2013.01)

(58) Field of Classification Search

CPC ..... B66B 13/22; B66B 5/0031; B66B 5/0025; B66B 5/0087; B66B 13/16; B66B 13/24; B66B 13/06; B66B 13/20; B66B 1/24; B66B 5/005; B66B 29/00; F16P 3/08

See application file for complete search history.

(56) References Cited

U.S. PATENT DOCUMENTS

| | | | |
|---|---|---|---|
| 5,690,188 | A | 11/1997 | Takakusaki et al. |
| 6,516,923 | B2 | 2/2003 | Lence et al. |
| 6,543,583 | B1 | 4/2003 | Lence et al. |
| 7,140,470 | B2 | 11/2006 | Azpitarte |
| 7,237,655 | B2 | 7/2007 | Kocher |
| 7,258,202 | B1 | 8/2007 | Rossignol |
| 7,650,971 | B2 | 1/2010 | Pillin et al. |
| 7,980,363 | B2 | 7/2011 | Kattainen et al. |

(Continued)

FOREIGN PATENT DOCUMENTS

| | | | |
|---|---|---|---|
| CN | 201325811 | Y | 10/2009 |
| CN | 201325812 | Y | 10/2009 |

(Continued)

*Primary Examiner* — Marlon T Fletcher
(74) *Attorney, Agent, or Firm* — Cantor Colburn LLP

(57) ABSTRACT

The present invention provides a maintenance safety apparatus for an elevator system and a method for operating the same, and belongs to the technical field of elevators. The maintenance safety apparatus of the present invention comprises a safety switch, a door lock device, a linkage control assembly and a linkage locking assembly. The maintenance safety apparatus of the present invention is very simple to operate and is capable of ensuring the safety of the staff entering a hoistway for performing maintenance operations.

26 Claims, 14 Drawing Sheets

(56) References Cited

U.S. PATENT DOCUMENTS

| | | | | |
|---|---|---|---|---|
| 8,069,958 | B2 | 12/2011 | Lence-Barreiro | |
| 8,256,581 | B2 | 9/2012 | Nowel | |
| 8,365,870 | B2 | 2/2013 | Sirigu et al. | |
| 8,490,755 | B2 | 7/2013 | Lindberg | |
| 8,602,171 | B2 | 12/2013 | Vogl | |
| 8,708,106 | B2 | 4/2014 | Räsänen et al. | |
| 9,108,823 | B2 | 8/2015 | Washio et al. | |
| 2004/0007429 | A1* | 1/2004 | Angst | B66B 13/143 187/317 |
| 2005/0034931 | A1* | 2/2005 | Deplazes | B66B 13/22 187/313 |
| 2006/0175147 | A1* | 8/2006 | Morotome | B66B 13/30 187/400 |
| 2006/0266589 | A1* | 11/2006 | Anttila | B66B 5/005 187/351 |
| 2007/0017752 | A1* | 1/2007 | Del Rio Sanz | B66B 5/0062 187/371 |
| 2010/0155184 | A1* | 6/2010 | Sirigu | B66B 5/0068 187/302 |
| 2014/0216856 | A1 | 8/2014 | Hovi et al. | |
| 2015/0251876 | A1 | 9/2015 | Fauconnet et al. | |
| 2015/0321882 | A1 | 11/2015 | Pursiainen et al. | |
| 2016/0130115 | A1* | 5/2016 | Blaska | B66B 5/0087 187/401 |
| 2017/0355569 | A1* | 12/2017 | Wang | B66B 5/0031 |
| 2019/0031468 | A1* | 1/2019 | Meguro | B66B 5/005 |

FOREIGN PATENT DOCUMENTS

| | | | |
|---|---|---|---|
| CN | 201560031 | U | 8/2010 |
| CN | 202369236 | U | 8/2012 |
| CN | 202464974 | U | 10/2012 |
| CN | 202481883 | U | 10/2012 |
| CN | 202625540 | U | 12/2012 |
| CN | 202988503 | U | 6/2013 |
| CN | 203545418 | U | 4/2014 |
| CN | 103818809 | A | 5/2014 |
| CN | 203682842 | U | 7/2014 |
| CN | 203767816 | U | 8/2014 |
| CN | 104085752 | A | 10/2014 |
| CN | 104203795 | A | 12/2014 |
| CN | 204384640 | U | 6/2015 |
| CN | 104773636 | A | 7/2015 |
| CN | 204508484 | U | 7/2015 |
| EP | 1281654 | A1 | 2/2003 |
| EP | 1440930 | A2 | 7/2004 |
| EP | 2050704 | A1 | 4/2009 |
| EP | 1110900 | B2 | 7/2011 |
| EP | 2444351 | A1 | 4/2012 |
| EP | 1728754 | B1 | 7/2013 |
| EP | 2623452 | A1 | 8/2013 |
| EP | 2671836 | A1 | 12/2013 |
| EP | 2927174 | A1 | 10/2015 |
| GB | 2193750 | A | 2/1988 |
| JP | H11222373 | A | 8/1999 |
| JP | 2000026051 | A | 1/2000 |
| JP | 2005132539 | A | 5/2005 |
| JP | 2012188200 | A | 10/2012 |
| JP | 2012218834 | A | 11/2012 |
| KR | 20060036381 | A | 4/2006 |
| WO | 2014184759 | A1 | 11/2014 |
| WO | 2014191380 | A1 | 12/2014 |
| WO | 2016027118 | A1 | 2/2016 |

* cited by examiner

Enlarged view
of area C

Enlarged view
of area D

MAINTENANCE SAFETY DEVICE FOR ELEVATOR AND A OPERATION METHOD THEREOF

PRIORITY

This application claims priority to Chinese Patent Application No. 201610400010.3, filed Jun. 8, 2016, and all the benefits accruing therefrom under 35 U.S.C. § 119, the contents of which in its entirety are herein incorporated by reference.

TECHNICAL FIELD

The present invention belongs to the technical field of elevators, and relates to the maintenance operations of the elevator by entering a hoistway, and in particular to a maintenance safety apparatus and a method for operating the same which enable a safety switch to be locked in a first state corresponding to a maintenance operating mode when a landing door is opened or during the opening operation of the landing door.

BACKGROUND ART

In the existing elevator systems, a staff needs to enter a pit of the hoistway or a car on the hoistway for manual maintenance operations such as inspection, maintenance, failure debugging, etc., when entering the hoistway, the staff first needs to use a dedicated unlocking tool (such as a triangular key) to open the landing door, and then enters the hoistway from the landing door.

The safety of the staff when performing the maintenance operations in the hoistway needs to be warranted. The elevator industry is also committed to ensuring the safety of the staff when performing the maintenance operations in the hoistway. To this end, corresponding regulations are carried out in the corresponding industry standards. For example, in accordance with the provisions of the Chinese standard GB7588.1 (see Section 5.12.1.5.2), a corresponding safety switch (such as an overhaul operation switch) is provided on the top of the car or in the pit, during the maintenance operations, there is a need to manually operate the safety switch to trigger the elevator system to be in a "maintenance operating mode", and after the maintenance operations, there is a need to manually operate the safety switch to trigger the elevator system to be in a "normal operating mode"; wherein the "normal operating mode" corresponds to the normal operation control, and the "maintenance operating mode" corresponds to the overhaul operation control. For example, there are corresponding regulations in the Chinese standard GB7588.1.

In the actual maintenance operations, there is a greater potential safety hazard that the staff forgets, neglects or does not perform the appropriate operation on the safety switch, so that the staff in the hoistway has a potential safety hazard during performing the maintenance operations.

SUMMARY OF THE INVENTION

According to an aspect of the present invention, provided is a maintenance safety apparatus for an elevator system, comprising:

a safety switch which, when placed in a first state, enables the elevator system to be in a maintenance operating mode, and when placed in a second state, enables the elevator system to be in a normal operating mode;

a door lock device configured to at least perform a locking operation and an unlocking operation on a landing door in a manual mode;

a linkage control assembly driven by the door lock device and linked with the locking operation and the unlocking operation, so as to cause the safety switch to be placed in the first state during the unlocking operation, and to cause the safety switch to be placed in the second state during the locking operation; and a linkage locking assembly configured to place the linkage control assembly in an actuation locked state when the landing door is opened or during the opening operation of the landing door, and to place the linkage control assembly in an actuation unlocked state when the landing door is closed or during the closing operation of the landing door.

According to a further aspect of the present invention, provided is a method for operating the aforementioned maintenance safety apparatus, comprising the following steps of:

performing an unlocking operation on the door lock device while driving the linkage control assembly to perform actuation, to enable the safety switch to be placed in the first state, wherein the corresponding elevator system is enabled to be in a maintenance operating mode when the safety switch is placed in the first state;

opening a landing door, wherein when the landing door is opened or during the opening operation of the landing door, the linkage control assembly is placed in an actuation locked state;

closing the landing door after a staff goes out from a hoistway, wherein when the landing door is closed or during the closing operation of the landing door, the linkage control assembly is placed in an actuation unlocked state; and performing a locking operation on the door lock device while driving the linkage control assembly to perform actuation, to enable the safety switch to be placed in the second state, wherein the elevator system is enabled to be in a normal operating mode when the safety switch is placed in the second state.

According to a yet further aspect of the present invention, provided is an elevator system, a landing door of which is provided with the aforementioned maintenance safety apparatus.

The above features and operations of the present invention will become more apparent from the following description and the accompanying drawings.

BRIEF DESCRIPTION OF THE DRAWINGS

The foregoing and other objectives and advantages of the present invention will become more fully apparent from the following detailed description taken in conjunction with the accompanying drawings, in which the same or similar elements are denoted by the same reference numerals.

DETAILED DESCRIPTION

The following is a description of some of the various possible embodiments of the present invention, which are intended to provide a basic understanding of the present invention and are not intended to identify key or determinative elements of the present invention or to define the scope of protection. It will be readily appreciated that other interchangeable implementation manners may be suggested by a person of ordinary skill in the art without departing from the spirit of the present invention in accordance with the technical solutions of the present invention. Accordingly, the following detailed description and accompanying drawings are only illustrative and should not be construed as the whole invention or as a definition or limitation to the technical solutions of the present invention.

In the following description, all of the various components shown in the figures are not described in detail for the purpose of clear and concise description. Various components that can be used by those of ordinary skilled in the art to fully implement the present invention are shown in the figures, and operations of many of the components not described are familiar and obvious to those skilled in the art.

In the present invention, the "maintenance operating mode" refers to a mode in which the staff in the hoistway is placed in a relatively safe environment. For example, the elevator system in the maintenance operating mode will satisfy: the car will not respond to any landing call, group controller commands or other remote commands; however, it should be understood that the specific conditions that the maintenance operating mode needs to satisfy are not restrictive, which can be set depending on the function of the elevator system, the safety requirements of the staff in the hoistway, etc.

Figure 1:
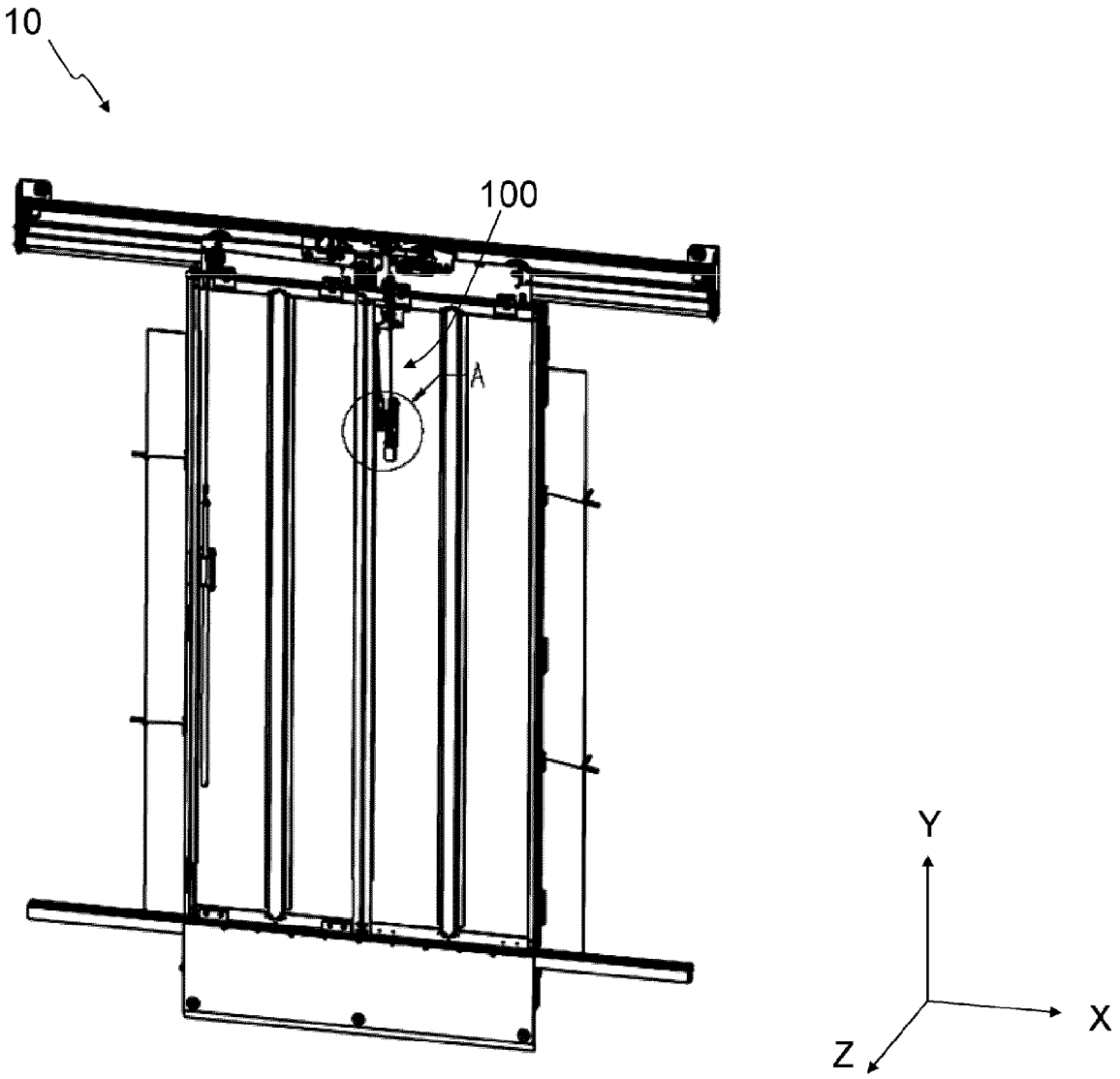
FIG. 1 is a rear view of a landing door of an elevator system according to one embodiment of the present invention.

In the following description, for the convenience of description, the width direction of the landing door of the elevator system is defined as the X direction, the height direction of the landing door of the elevator system is defined as the Y direction, and the direction substantially perpendicular to the landing door of the elevator system is defined as the Z direction. It should be understood that these directions are defined for relative description and clarification, which may accordingly vary with the orientation of an elevator brake. FIG. 1 is a rear view of the landing door viewed from the hoistway, and FIG. 3 shows a front view of the landing door viewed from a lobby.

The maintenance safety apparatus of the present invention, the elevator system using the same, and the method for operating the maintenance safety apparatus will be described in detail with reference to FIGS. 1 to 14.

Figure 2:
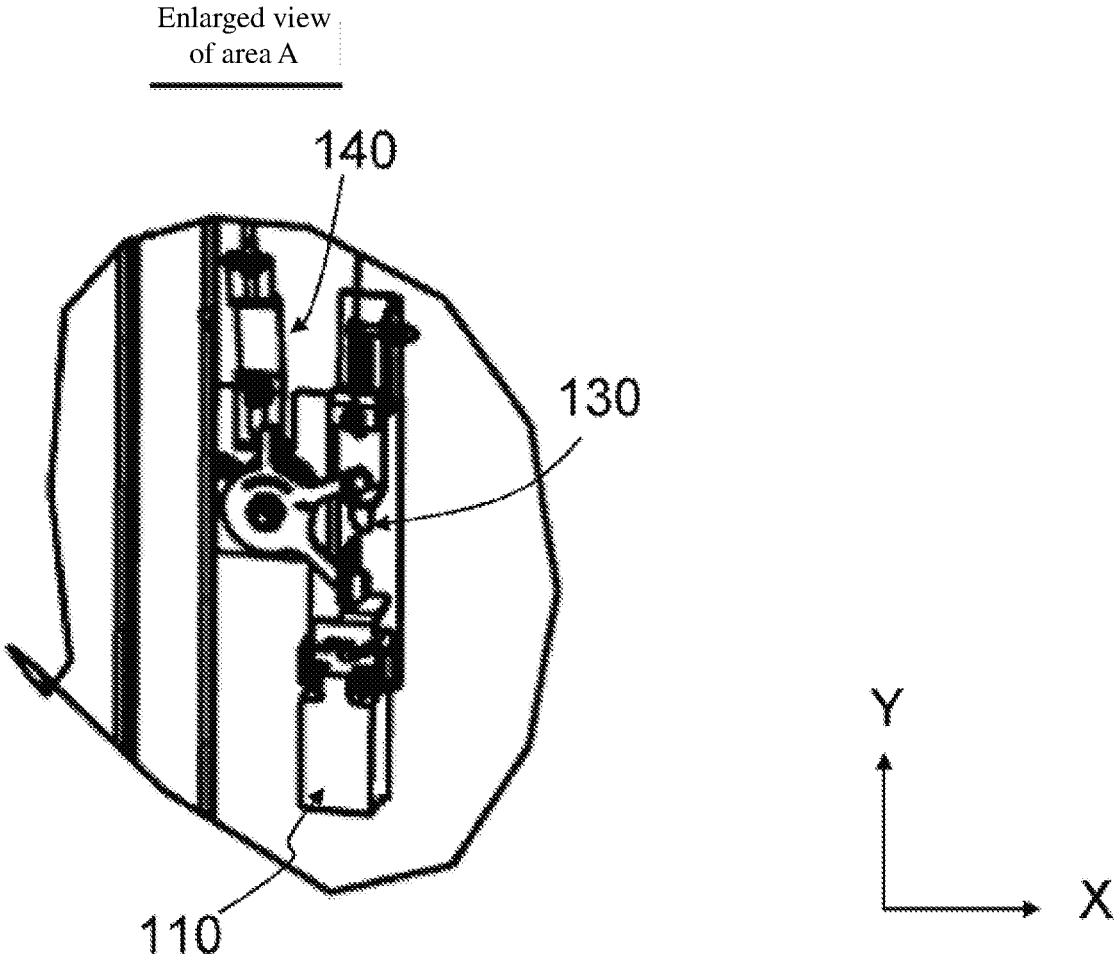
FIG. 2 is an enlarged view of area A in a maintenance safety apparatus of the landing door of the embodiment shown in FIG. 1.
Figure 3:
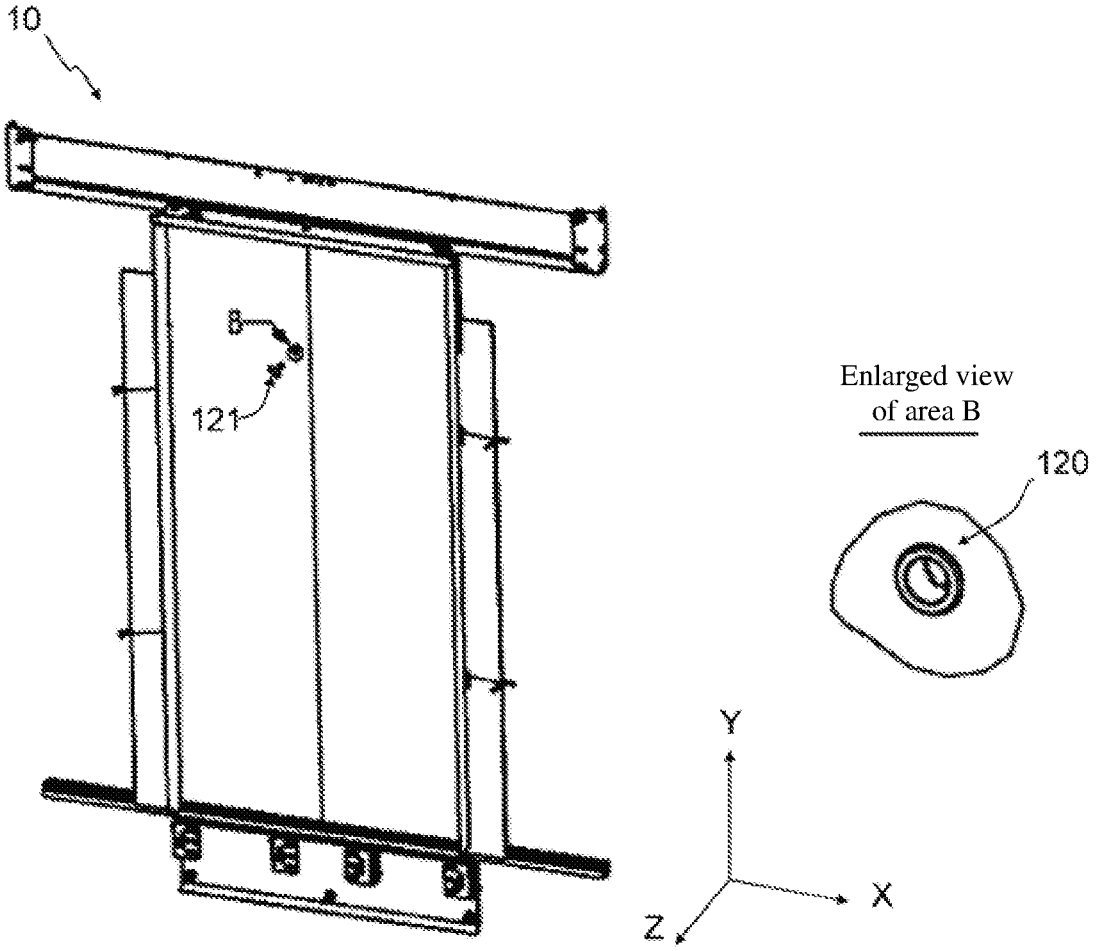
FIG. 3 is a front view of a landing door of an elevator system according to one embodiment of the present invention.
Figure 4:
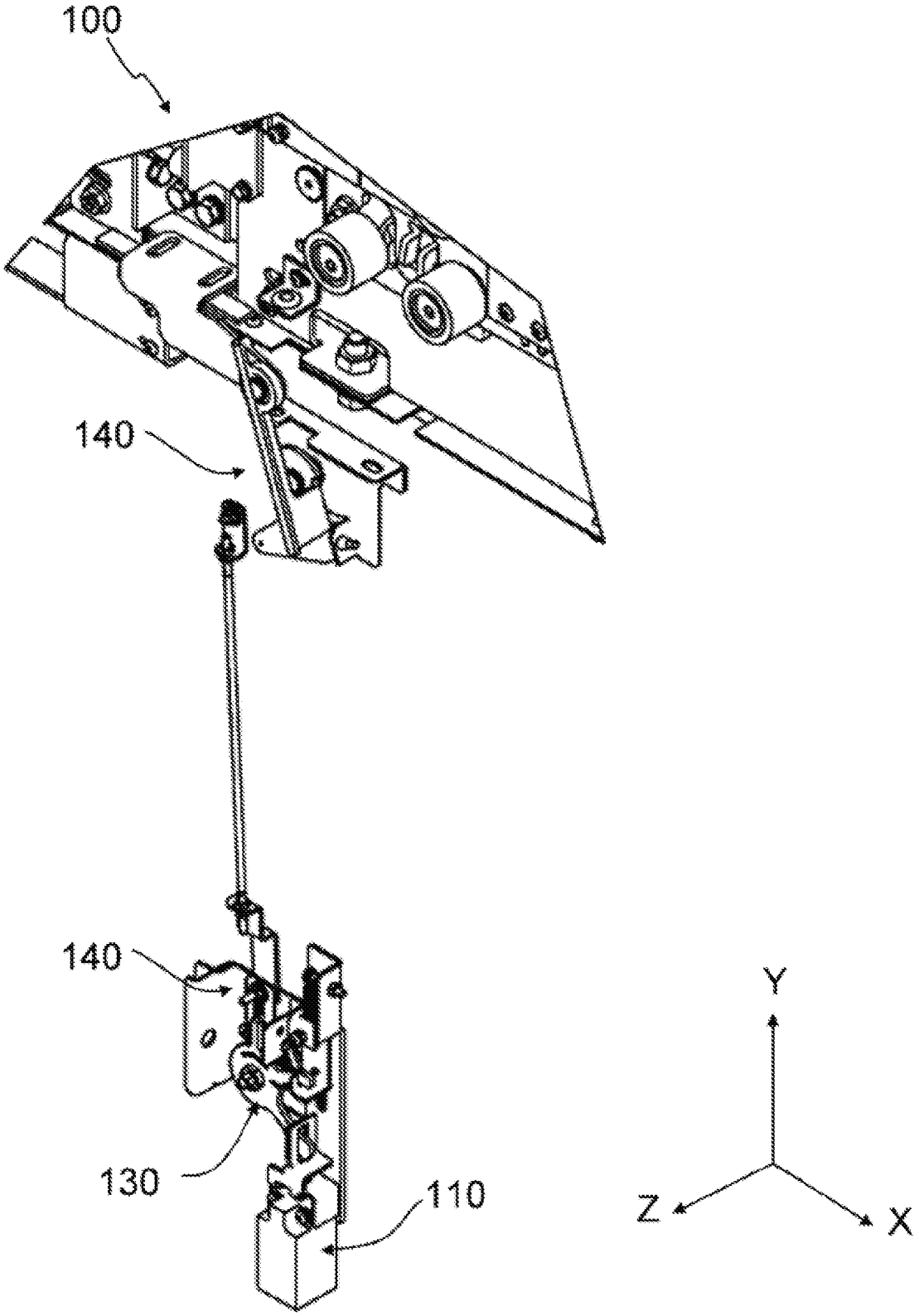
FIG. 4 is a schematic structural view of a maintenance safety apparatus according to one embodiment of the present invention.
Figure 5:
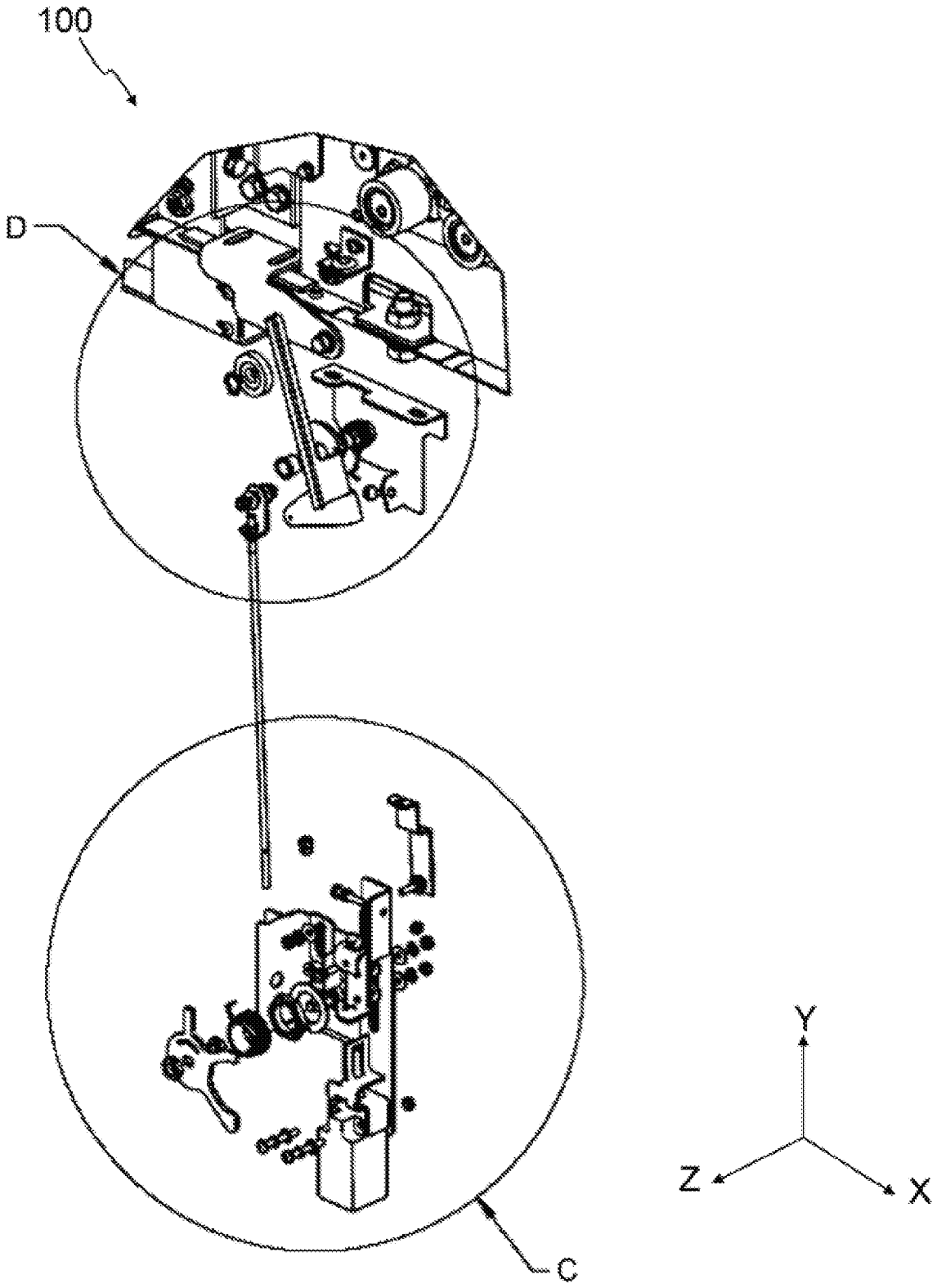
FIG. 5 is an exploded view of the maintenance safety apparatus of the embodiment shown in FIG. 4.

As shown in FIGS. 1 to 3, a landing door 10 of an elevator system according to an embodiment of the present invention is shown. A maintenance safety apparatus 100 of the elevator according to the embodiment of the present invention is mainly provided on the landing door 10. The maintenance safety apparatus 100 mainly comprises a safety switch 110, a door lock device 120, a linkage control assembly 130 and a linkage locking assembly 140.

The safety switch 110 may be fixedly disposed on the side of the landing door 10 facing the hoistway, which may be specifically a bistable switch having two states, namely a first state and a second state, respectively corresponding to the maintenance operating mode and the normal operating mode of the elevator system. That is to say, the bistable safety switch 110 enables the elevator system to be in the maintenance operating mode when placed in the first state, and the bistable safety switch 110 enables the elevator system to be in the normal operating mode when placed in the second state.

It should be noted that an elevator control system, of the elevator system, to which the safety switch 110 is coupled is not shown, which is pre-defined or set to have the maintenance operating mode and the normal operating mode, and the elevator control system can be triggered by the safety switch 110 to switch between the maintenance operating mode and the normal operating mode.

Referring to FIG. 3, the door lock device 120 may also be fixed to the landing door 10, one of the functions thereof is performing a locking operation and an unlocking operation on the landing door 10 in a manual mode; after the locking operation, the landing door 10 cannot be opened when the door of the car is not open, thus preventing the person concerned from entering the hoistway; and after the unlocking operation, the landing door 10 can be manually opened (for example, breaking off the landing door with hands) by the stuff to be in the open state, thus facilitating the stuff entering the hoistway to carry out maintenance operations. The above locking operation and unlocking operation are accomplished by a key 121 of the door lock device 120, and can also be conveniently accomplished on the side of the landing door 10 facing the lobby as shown in FIG. 3, and the key 121 may be specifically, but is not be limited to, a triangular key 121.

Referring to FIGS. 4 to 10, the structures, functions and operating principles of the linkage control assembly 130 and the linkage locking assembly 140 are specifically illustrated.

The main components of the linkage control assembly 130 comprise a linkage engagement plate 131, a first bracket 132 and a second bracket 133. In this embodiment, the linkage engagement plate 131 is configured to be capable of being rotated in linkage with the unlocking and unlocking operations on the door lock device 120, in particular, being rotated in linkage with the key 121 of the door lock device 120 during the locking and unlocking operations. For example, when the triangular key 121 is rotated in the clockwise direction in the visible XY plane shown in FIG. 4 (corresponding to the counterclockwise direction in the visible XY plane shown in FIG. 3) for performing the unlocking operation, the linkage engagement plate 131 is also synchronously driven to rotate in the clockwise direction; and when the triangular key 121 is rotated in the counterclockwise direction in the visible XY plane shown in FIG. 4 (corresponding to the counterclockwise direction in the visible XY plane shown in FIG. 3) for performing the locking operation, the linkage engagement plate 131 is also synchronously driven to rotate in the counterclockwise direction.

In one embodiment, the door lock device 120 includes a lock cylinder shaft 122, the triangular key 121 is inserted into the lock cylinder shaft 122 to rotate, a fixing hole is provided in the middle of the linkage engagement plate 131, and the linkage engagement plate 131 can be fixed to the lock cylinder shaft 122 of the door lock device 120 through the fixing hole. A torsion spring 136 is provided between the door lock device 120 and the linkage engagement plate 131, and the linkage engagement plate 131 and the door lock device 120 can be integrally provided via a bolt or the like, so that the structure is simple and compact. It should be noted that the specific structure of the door lock device 120 is not restrictive and that it can be a door lock device, for a landing door, of any existing type.

Figure 9:
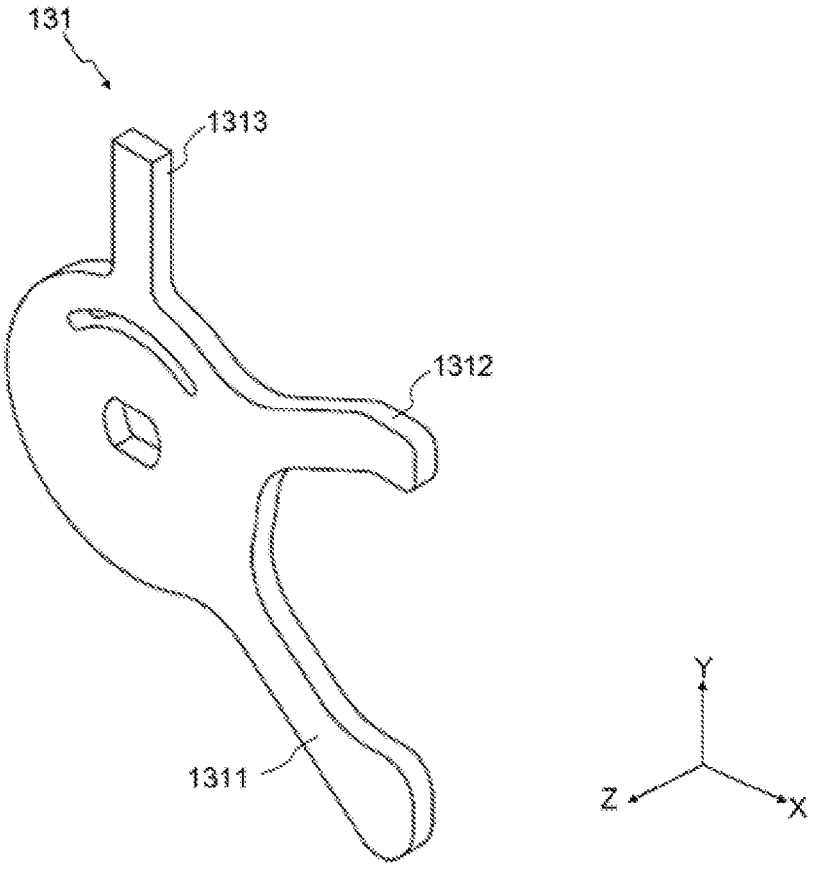
FIG. 9 is a schematic structural view of a linkage engagement plate of a linkage control assembly of the maintenance safety apparatus of the embodiment shown in FIG. 4.
Figure 10:
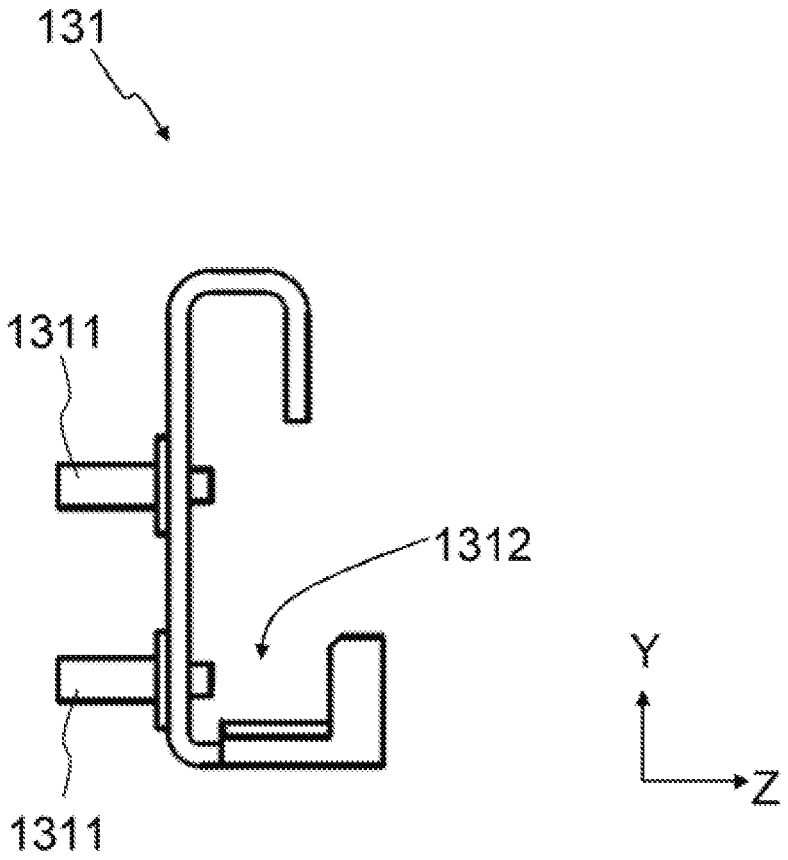
FIG. 10 is a schematic structural view of a second bracket of the linkage control assembly of the maintenance safety apparatus of the embodiment shown in FIG. 4.

In one embodiment, the linkage engagement plate 131 is fixedly provided with a trigger lug 1312, a restoring lug 1311 and a stop lug 1313 (as shown in FIG. 9), wherein the trigger lug 1312, the restoring lug 1311 and the stop lug 1313 are all relatively raised outwardly, the specific shapes thereof are not limited to the illustrated embodiment of the present invention, and the interval angle, shape, etc. among the trigger lug 1312, the restoring lug 1311 and the stop lug 1313 may be specifically designed according to the first bracket 132, the second bracket 133 and other parts that are provided in association therewith. The restoring lug 1311, the trigger lug 1312 and the stop lug 1313 are arranged in sequence in the counterclockwise direction in the visible XY plane shown in FIG. 4. The outer diameter of the stop lug 1313 is smaller than that of the trigger lug 1312, for example, the outer diameter of the stop lug 1313 is about one-half of the outer diameter of the trigger lug 1312, so that the stop lug 1313 does not interact with the second bracket 133 when the linkage engagement plate 131 is rotated in the clockwise direction.

Accordingly, the first bracket 132 of the linkage control assembly 130 may act directly on the safety switch 110, thereby triggering the safety switch 110 to be in the first state or the second state. The linkage control assembly 130 is further provided with a base plate 134 and a tension spring 135, wherein the tension spring 135 may be specifically formed by a resilient element such as a spring, and may hang the second bracket 133 on the base plate 134; and the base plate 134 may be stamped from various metal plate materials, on which a first guide groove 1341 is provided, and the first guide groove 1341 is provided corresponding to the second bracket 1312. Specifically, pins (for example, two pins) provided on the back surface of the second bracket 1312 are embedded into the first guide groove 1341 and restricted to move up and down in the first guide groove 1341.

When the unlocking operation is performed using the triangular key 121, the linkage engagement plate 131 is rotated in linkage therewith in, for example, the clockwise direction, the trigger lug 1312 may act on the second bracket 1312 and is depressed against the second bracket 1312, the second bracket 1312 is depressed by the trigger lug 1312, and the second bracket 133 linearly moves downwardly along the first guide groove 1341. When the locking operation is performed using the triangular key 121, the linkage engagement plate 131 is rotated in the counterclockwise direction, and the second bracket 133 is upwardly restored and linearly moves along the first guide groove 1341 under the pulling action of the tension spring 135. Hence, the second bracket 133 is able to transform the rotation of the trigger lug 1312 into the upward and downward linear movements. Moreover, after moving downwardly to a predetermined position, the second bracket 133 will be depressed against the first bracket 132, and in turn trigger the safety switch 110 via the first bracket 132 to be placed in the first state corresponding to the maintenance operating mode.

Figure 6:
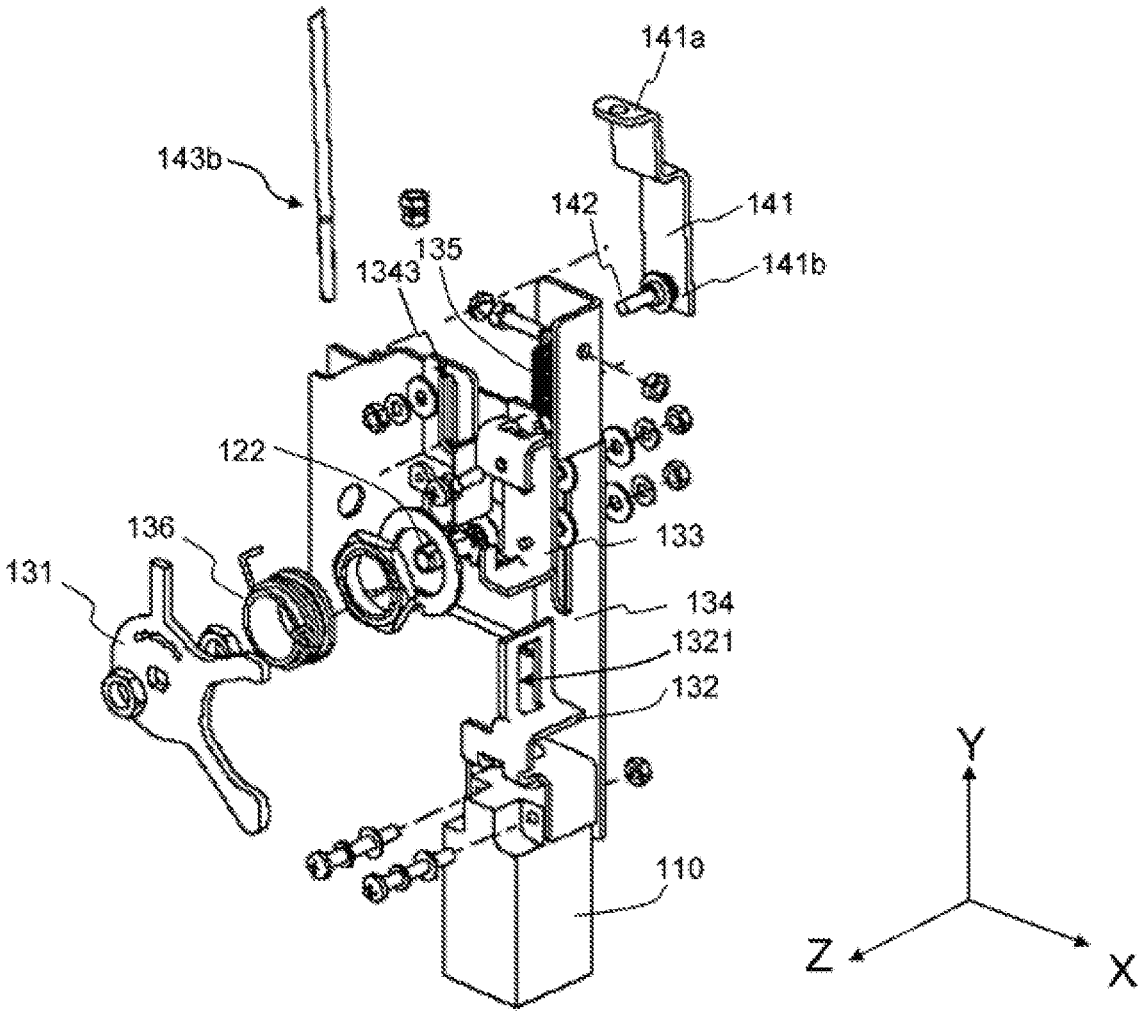
FIG. 6 is an enlarged view of area C in the maintenance safety apparatus of the embodiment shown in FIG. 5.

The first bracket 132 is also specifically provided with a slotted hole 1321 as shown in FIG. 6, in this embodiment, the slotted hole 1321 is generally rectangular in shape and is designed corresponding to the restoring lug 1311. When the locking operation is performed using the triangular key 121, the linkage engagement plate 131 is rotated in the counterclockwise direction, the restoring lug 1311 is also rotated in the counterclockwise direction synchronously, so that the top of the restoring lug 1311 is aligned and enters into the slotted hole 1321 of the first bracket 132 and pulls the first bracket 132 upwards, and thus the safety switch 110 is in turn restored from the first state corresponding to the maintenance operating mode to the second state corresponding to the normal operating mode.

Therefore, the maintenance safety apparatus 100 of the embodiment of the present invention can realize the following functions: when the unlocking operation on the landing door is performed using the triangular key, the safety switch is substantially simultaneously triggered to be placed in the first state corresponding to the maintenance operating mode, so that the unlocking operation on the landing door 100 and the operation on the safety switch can be combined, and the unlocking operation on the landing door 100 necessarily achieves that the safety switch 110 is placed in the first state corresponding to the maintenance operating mode, and the elevator system is necessarily in the maintenance operating mode before the stuff enters the hoistway, and thus not only the operation process is simple (which can be completed in the lobby), but also the staff can be prevented from the danger brought about due to forgetting to operate or operating the safety switch 110 not in accordance with the regulations, the operations on the safety switch 110 are all completed indirectly by the triangular key 121, and the safe reliability is easily guaranteed; and when the locking operation on the landing door 100 is performed using the triangular key 121, the safety switch 110 is substantially simultaneously triggered to be placed in the second state corresponding to the normal operating mode, it can be ensured that the safety switch 110 is placed in the second state corresponding to the normal operating mode after the stuff leaves the hoistway, to avoid the danger brought about due to restoring the safety switch 110 to the second state in the hoistway, the operation process (which can be achieved in the lobby) is likewise simple, and the safe reliability of the staff is easily guaranteed.

The inventors of the present application further found that after the unlocking operation is performed on the landing door 100 and the landing door 100 is in the open state, at this point, the stuff generally enters the hoistway for performing the maintenance operations; however, even if the safety switch 110 is in the relatively safe first state, it is highly likely that the associated operator will twist the triangular key 121 (e.g., non-standard operation or erroneous locking operation) when the landing door 10 is opened or during the opening operation of the landing door 10, and now it would also be possible for the maintenance safety apparatus 100 of the above embodiment to synchronously place the safety switch 110 in the relatively dangerous second state, which would inevitably bring about great harm to the staff in the hoistway.

To this end, the maintenance safety apparatus 100 of the embodiment of the present invention is further provided with a linkage locking assembly 140, wherein the linkage locking assembly 140 is configured to place the linkage control assembly 130 in an actuation locked state when the landing door 10 is opened or during the opening operation of the landing door 10, and to place the linkage control assembly 130 in an actuation unlocked state when the landing door 10 is closed or during the closing operation of the landing door 10. In this way, when the landing door 10 is opened or during the opening operation of the landing door 10, the operation on the triangular key 121 will not affect the actuation of the lock control assembly 130, i.e., it can be ensured that the safety switch 110 is in the relatively safe first state, so that the danger brought about by the above non-standard operation or the erroneous locking operation is avoided.

Figure 7:
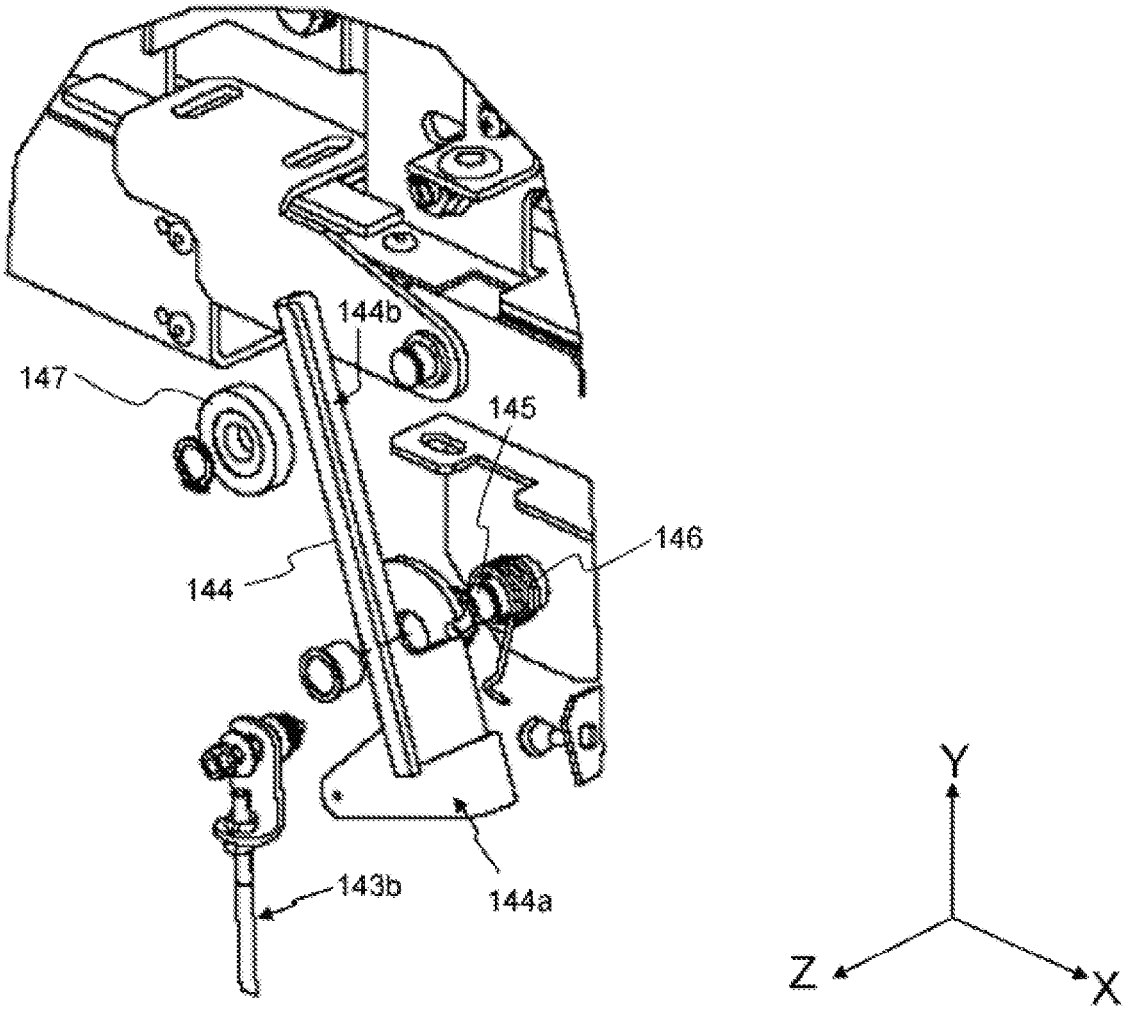
FIG. 7 is an enlarged view of area D in the maintenance safety apparatus of the embodiment shown in FIG. 5.
Figure 8:
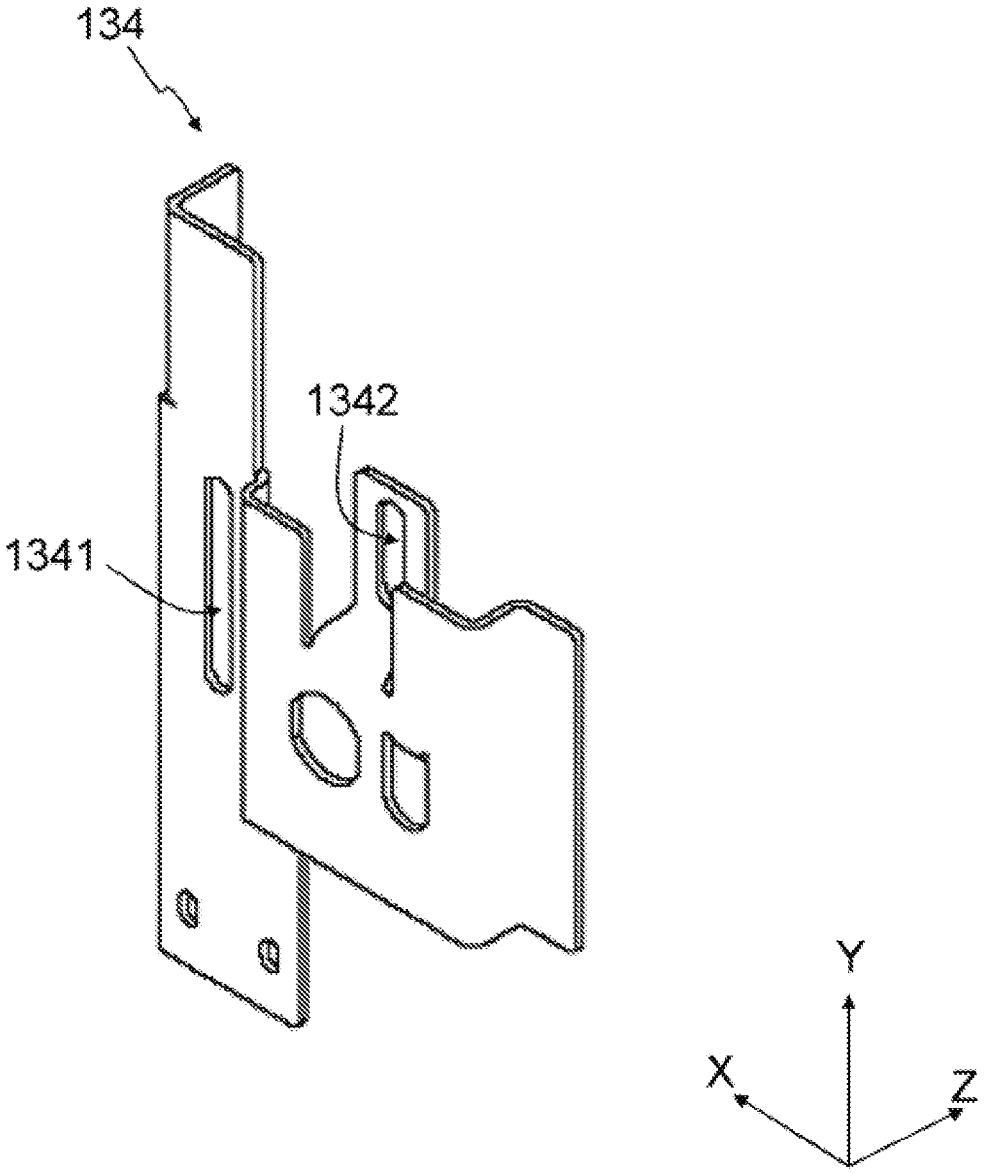
FIG. 8 is a schematic structural view of a base plate of the maintenance safety apparatus of the embodiment shown in FIG. 4.

In one embodiment, the linkage locking assembly 140 is disposed above the linkage control assembly 130, which comprises a striking bow 144, a connecting rod 143, a third bracket 141, and a stop pin 142. Referring to FIG. 7, the striking bow 144 is also provided on the side of the landing door 100 facing the hoistway, which is fixed to the landing door 100 via a rotating shaft 145 and is capable of rotating around the rotating shaft 145 substantially in the XY plane, the rotating shaft 145 is specifically provided in the middle of the striking bow 144, the lower end 144*a* of the striking bow 144 is connected, for example, hinged to the upper end 143*b* of the connecting rod 143, the upper end 144*b* of the striking bow 144 is disposed relative to a roller 147 on the landing door 10,when the landing door 10 is closed or during the closing operation of the landing door 10, the roller 147 rolls relative to the striking bow 144 and urges the striking bow 144 to rotate to a substantially vertical position (i.e., the second position), and the lower end 144*a* of the striking bow 144 pulls the rigid connecting rod 143 in a hooked manner to move substantially upwardly. The lower end 143*a* of the connecting rod 143 is connected to the third bracket 141, the third bracket 141 is provided with a stop pin 142 which is opposed to the second guide groove 1342 on the base plate 134, and the stop pin 142 can pass through the second guide groove 1342 and be located above the linkage engagement plate 131, the length of the stop pin 142 being set such that it can at least reach the position where the linkage engagement plate 131 is located in the Z direction.

When the landing door 10 is opened or during the opening operation of the landing door 10, the striking bow 144 is driven to the first position, e.g., the position relatively inclined at an angle (in the XY plane), and in turn can push the stop pin 143 via the connecting rod 142 to the lower end position, so that the stop pin 142 will interfere with the rotation of the linkage engagement plate 131, and the linkage engagement plate 131 can be locked in a position corresponding to the first state, i.e., the linkage locking assembly 140 is in the actuation locked state, at this time, the linkage locking assembly 140 cannot transform the safety switch 110 from the first state to the second state. When the landing door 10 is closed or during the closing operation of the landing door 10, the striking bow 144 is driven to the second position, e.g., the position in the vertical direction (substantially Y-direction), and in turn can pull the stop pin 143 in a hooked manner via the connecting rod 142 to the upper end position, so that the stop pin 142 cannot interfere with the rotation of the linkage engagement plate 131, and the linkage engagement plate 131 is unlocked, i.e., the linkage locking assembly 140 is in the actuation unlocked state, at this time, the linkage locking assembly 140 can transform the safety switch 110 from the first state to the second state under the operation on the triangular key 121.

In one embodiment, a torsion spring 146 is provided on the rotating shaft 145 in a manner corresponding to the striking bow 144, and the torsion spring 146 may rotate the striking bow 144 (e.g., when the landing door 10 is opened or during the opening operation of the landing door 10) from the second position in the vertical direction to the first position in the above-described inclined direction, to achieve active locking of the linkage engagement plate 131 when the landing door 10 is opened or during the opening operation of the landing door 10. The torsion spring 146, the striking bow 144, the rotating shaft 145 and the roller 147 generally constitute a crank slider mechanism.

Specifically, the upward and downward movements of the stop pin 142 are completed in the second guide groove 1342, and the second guide groove 1342 guides the movement of the stop pin 142 under the driving of the striking bow 144, such that the stop pin 142 can run linearly up and down along the second guide groove 1342. When the stop pin 142 moves to the lower end position, i.e., to the bottom of the second guide groove 1342, the stop lug 1313 of the stop plate 131, for example, the rotation of the stop lug 1313 in the counterclockwise direction can be stopped, so that even if the triangular key 121 is operated, the linkage engagement plate 131 is not rotated in linkage therewith at this time, so as to ensure that the safety switch 110 is placed in the relatively safe first state. When the stop pin 142 moves to the upper end position, i.e., to the top of the second guide groove 1342, the length of the second guide groove 1342 and the dimensions of the trigger lug 1312 and the stop lug 1313 can be designed such that the stop pin 142 does not affect the rotation of the linkage engagement plate 131, i.e., the locking is released, and under the operation on the triangular key 121, the linkage engagement plate 131 can be rotated in linkage therewith to freely trigger the safety switch 110.

It should be noted that, the linkage locking assembly 140 of the above embodiments acts on the linkage locking assembly 140 correspondingly through the opening or closing of the landing door, and the linkage locking assembly 140 is linked with the opening or closing of the landing door, so that the locking of the actuation of the linkage control assembly 130 is achieved, and the situation that the safety switch 110 is restored to the relatively dangerous second state in a state where the landing door is opened due to the misoperation on the triangular key 121 is avoided. Based on the teaching or inspiration of the above embodiments, it is possible to design a linkage locking assembly 140 having a specific structure which is different from those in the embodiments of the present invention. For example, by designing the shape of the striking bow 144, the stop pin 142 can be placed at the lowermost end to have a stopping function when the striking bow 144 is the position in the vertical direction, and the stop pin 142 is placed at the uppermost end to release the locking of the linkage engagement plate 131 when the striking bow 144 is in the position at an inclined angle.

The operating principle and operation method of the maintenance safety apparatus 100 of the embodiments of the present invention are specifically described in detail with reference to FIGS. 11 to 14.

Figure 11:
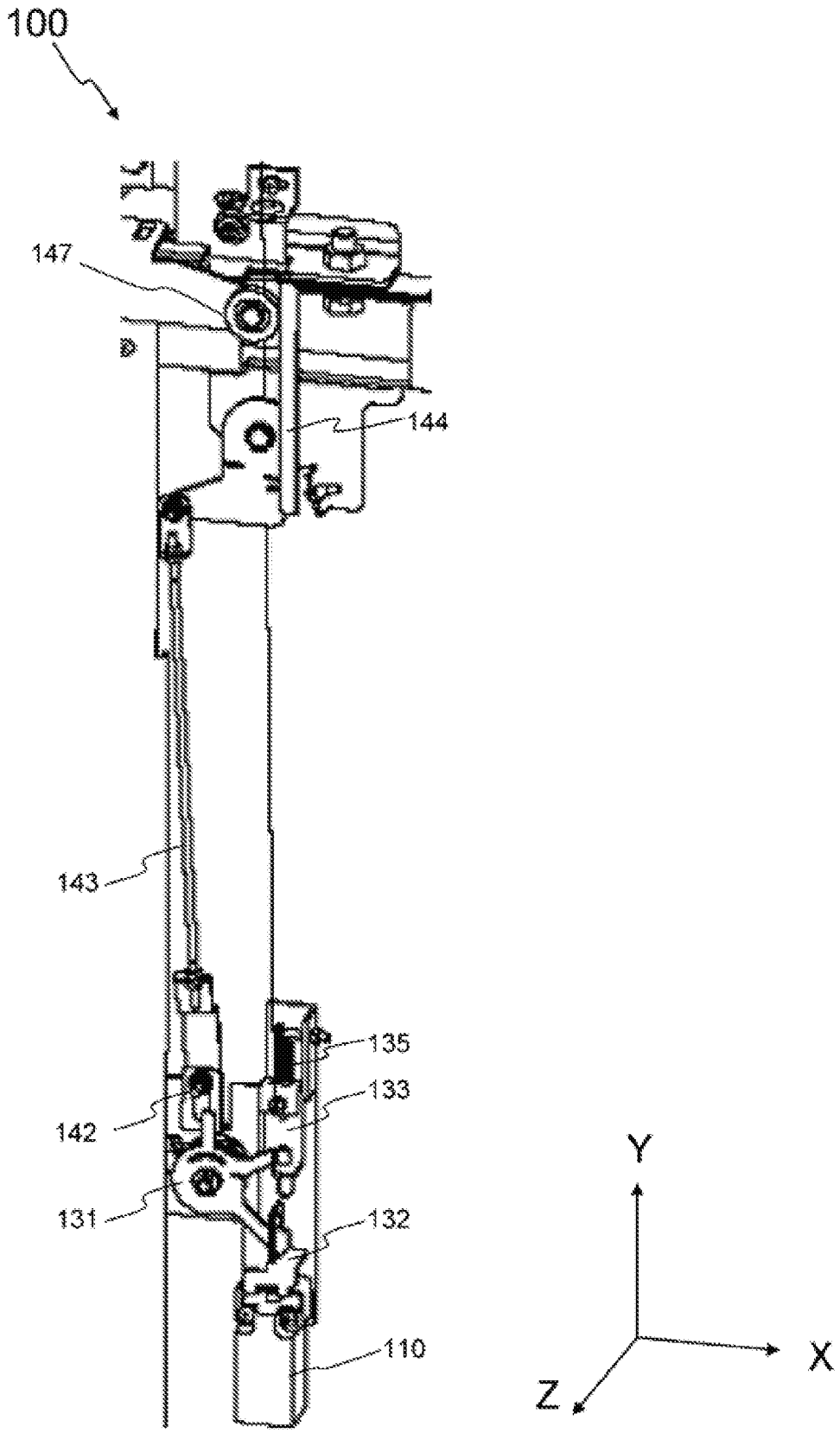
FIG. 11 is a schematic structural view of the maintenance safety apparatus of the embodiment shown in FIG. 4, with the linkage control assembly thereof being placed in an actuation unlocked state.

Firstly, the landing door 100 is in the initial closed state, at this time, the elevator system is operating normally, i.e. the safety switch 110 is placed in the second state corresponding to the normal operating mode; and as shown in FIG. 11, the striking bow 144 is placed in the second position in the vertical direction at this time, the stop pin 142 is placed at the top of the second guide groove 1342, the stop pin 142 does not interfere with or affect the rotation of the linkage engagement plate 131, and the linkage engagement plate 131 is not locked, so that it is possible to prepare the next unlocking operation for the door lock device 120.

Figure 12:
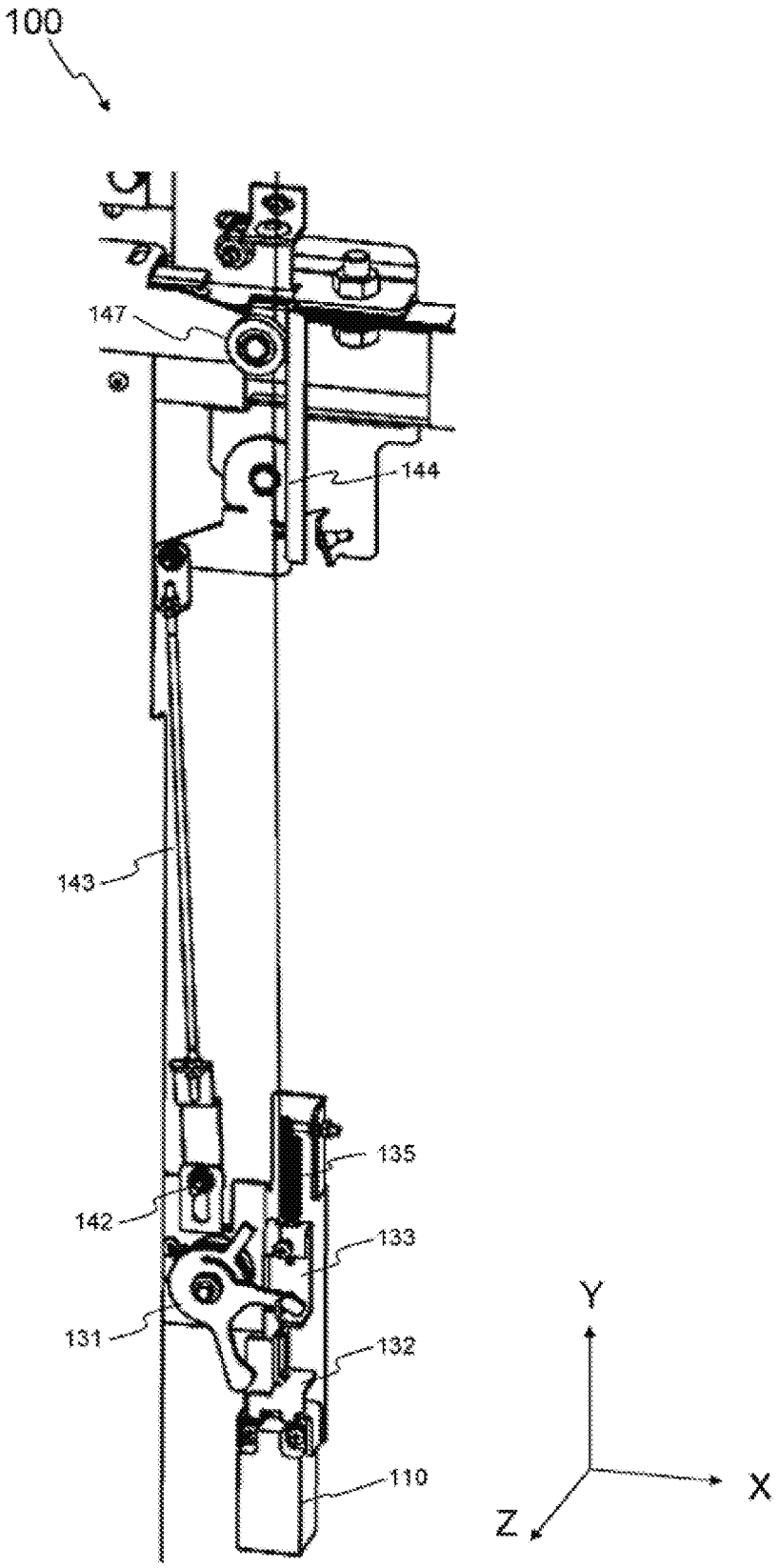
FIG. 12 is a schematic structural view of the maintenance safety apparatus of the embodiment shown in FIG. 4, with the safety switch thereof being triggered to be placed in a first state corresponding to the maintenance operating mode.

Next, the door lock device 120 is unlocked and the linkage control assembly 130 is driven to perform actuation to enable the safety switch 110 to be placed in the relatively safe first state. Specifically, as shown in FIG. 12, when the unlocking operation is performed using the triangular key 121, the linkage engagement plate 131 is rotated in linkage therewith in a certain direction, for example, in the clockwise direction, and the trigger lug 1312 of the linkage engagement plate 131 is depressed against the second bracket 133, thereby causing the second bracket 133 to be depressed against the first bracket 132 and to trigger the safety switch 110 to transform from the second state to the first state corresponding to the maintenance operating mode. In this case, the elevator system is in the maintenance operating mode, and it is relatively safe for the staff to enter the hoistway for performing maintenance operations.

Figure 13:
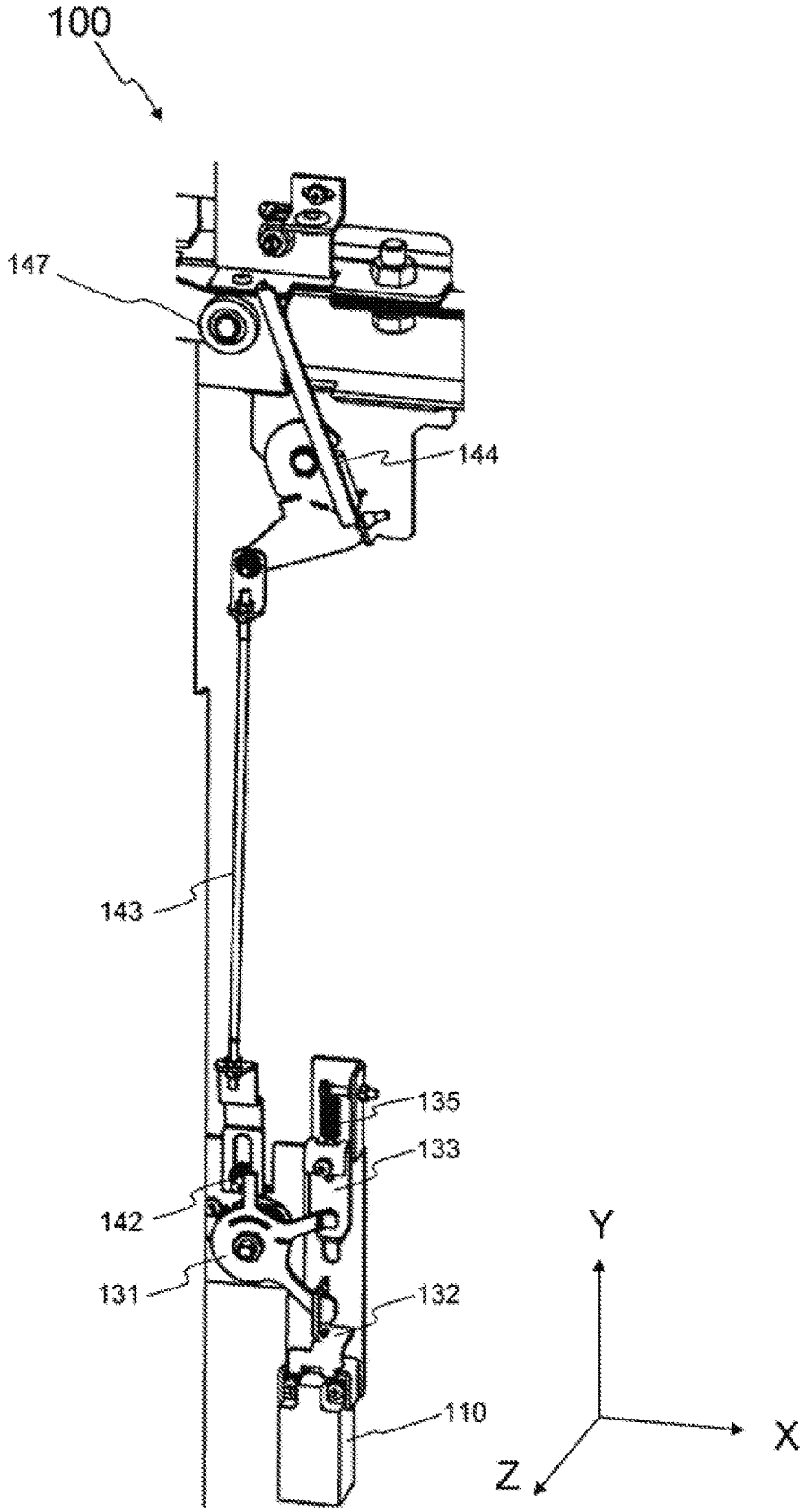
FIG. 13 is a schematic structural view of the maintenance safety apparatus of the embodiment shown in FIG. 4, with the linkage control assembly thereof being placed in an actuation locked state.

Next, when the landing door 10 is opened or during the opening operation of the landing door 10, the linkage control assembly 130 is automatically placed in the actuation locked state. Specifically, as shown in FIG. 13, the opening operation of the landing door causes the striking bow 144 to be obliquely fixed in the first position at a certain angle so as to push the connecting rod 143 downward to a lower point, the stop pin 142 moves to the lower end position of the second guide groove 1342, and is capable of preventing the stop lug 1313 of the linkage engagement plate 131 from moving in the counterclockwise direction, to lock the linkage engagement plate 131. In this case, the linkage engagement plate 131 cannot synchronously move in the counterclockwise direction at this time, even if a person in the lobby incorrectly operates the triangular key 121, for example, carrying out the locking operation, the safety switch 110 is locked in the first state at this stage, and thus the safety of the staff in the hoistway can be guaranteed.

Next, after the maintenance operations are completed, especially after the staff goes out from the hoistway, the landing door needs to be closed first, and therefore, when the landing door 10 is closed or during the closing operation of the landing door 10, the linkage control assembly 130 is placed in an actuation unlocked state. Specifically, the closing operation of the landing door returns the striking bow 144 from the first position shown in FIG. 13 to the second position in the vertical direction shown in FIG. 11, the stop pin 142 is returned to the top of the second guide groove 1342, the stop pin 142 does not interfere with or affect the rotation of the linkage engagement plate 131, the locking of the linkage engagement plate 131 is released, and at this time, it is possible to prepare the locking operation.

Figure 14:
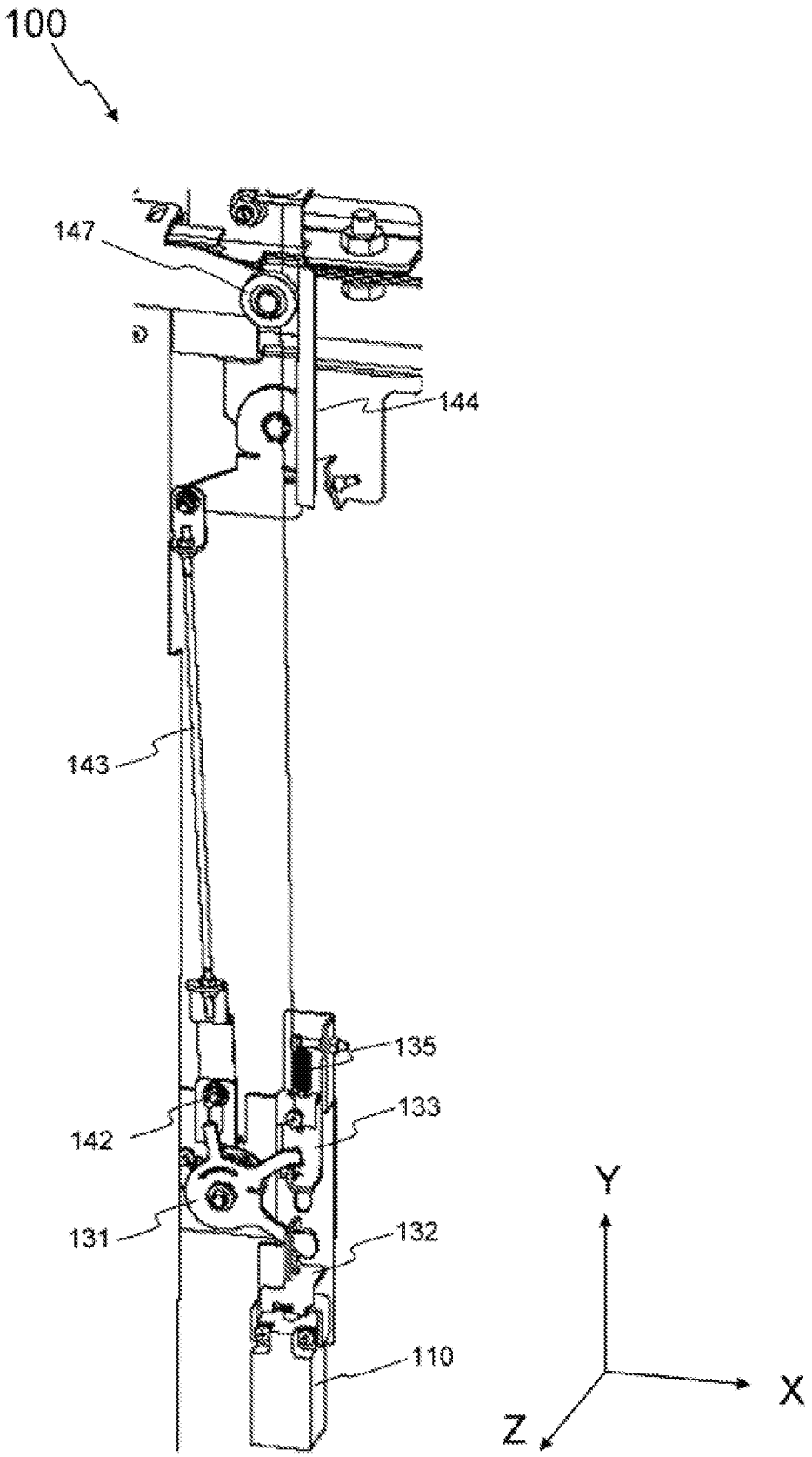
FIG. 14 is a schematic structural view of the maintenance safety apparatus of the embodiment shown in FIG. 4, with the safety switch thereof being triggered to be placed in a second state corresponding to the normal operating mode.

Next, the door lock device 120 is locked and the linkage control assembly 130 is driven to perform actuation to enable the safety switch 110 to be placed in the second state corresponding to the normal operating mode. Specifically, as shown in FIG. 14, when the locking operation is performed using the triangular key 121, the linkage engagement plate 131 is rotated in linkage therewith in the opposite direction, for example, in the counterclockwise direction, and the restoring lug 1311 of the linkage engagement plate 131 pulls the first bracket 132, thereby causing the first bracket 132 to trigger the safety switch 110 to transform from the first state to the second state corresponding to the normal operating mode. In this case, the elevator system is in the normal operating mode.

Therefore, the staff only needs to perform the unlocking operation in the lobby, open the landing door, close the landing door after the maintenance operations are completed, and perform the locking operation, to guarantee the absolute safety of the stuff entering the hoistway, and the above operation processes are necessary steps to be completed, which are not easily forgotten or circumvented, so that the operations are simple.

The above-mentioned elevator system using the maintenance safety device 100 not only can at least meet the relevant requirements of the Chinese standard GB7588.1, but also makes the operations very simple, and completely avoids the potential safety hazard caused by the improper operation or non-standard operation by the staff, so that the safe reliability of the maintenance operations can be guaranteed.

The above examples mainly describe a maintenance safety apparatus of the present invention and a method for operating the same. Although only some of the embodiments of the present invention have been described, it should be understood by those of ordinary skill in the art that the present invention may be implemented in many other forms without departing from the spirit and scope thereof, for example, the trigger lug 1312 and the restoring lug 1311 are combined as a whole. The illustrated examples and embodiments are therefore to be considered as illustrative and not restrictive, and the present invention may cover various modifications and substitutions without departing from the spirit and scope of the present invention as defined by the appended claims.

What is claimed is:

1. A maintenance safety apparatus (100) for an elevator system, comprising:

a safety switch (110) which, when placed in a first state, enables the elevator system to be in a maintenance operating mode, and when placed in a second state, enables the elevator system to be in a normal operating mode;

a door lock device (120) configured to at least perform a locking operation and an unlocking operation on a landing door (10) in a manual mode;

a linkage control assembly (130) driven by the door lock device (120) and linked with the locking operation and the unlocking operation, so as to cause the safety switch (110) to be placed in the first state during the unlocking operation, and to cause the safety switch (110) to be placed in the second state during the locking operation; and a linkage locking assembly (140) configured to place the linkage control assembly (130) in an actuation locked state when the landing door (10) is opened or during the opening operation of the landing door (10), and to place the linkage control assembly (130) in an actuation unlocked state when the landing door (10) is closed or during the closing operation of the landing door (10).

2. The maintenance safety apparatus (100) according to claim 1, characterized in that the linkage control assembly (130) comprises a linkage engagement plate (131), wherein the linkage engagement plate (131) is configured to rotate in linkage with a key (121) of the door lock device (120) during the locking operation and the unlocking operation.

3. The maintenance safety apparatus (100) according to claim 2, characterized in that the linkage engagement plate (131) is fixedly provided with a trigger lug (1312), a restoring lug (1311) and a stop lug (1313).

4. The maintenance safety apparatus (100) according to claim 3, characterized in that the linkage control assembly (130) further comprises:

a first bracket (132) configured to trigger the safety switch (110), and a second bracket (133) configured to transform the rotation of the trigger lug (1312) into upward and downward linear movements, wherein during the unlocking operation, the trigger lug (1312) is rotated in linkage with the key (121) in a first direction and is depressed against the second bracket (133), and the second bracket (133) is in turn depressed against the first bracket (132) and triggers the safety switch (110) to transform from the second state to the first state; and during the locking operation, the restoring lug (1311) is rotated in linkage with the key (121) in a second direction opposite to the first direction and pulls the first bracket (132), and in turn restores the safety switch (110) from the first state to the second state.

5. The maintenance safety apparatus (100) according to claim 4, characterized in that the stop lug (1313) is configured to be stopped by the linkage locking assembly (140) when the landing door (10) is opened or during the opening operation of the landing door (10), to lock the rotation of the linkage engagement plate (131) at least in the second direction.

6. The maintenance safety apparatus (100) according to claim 3, characterized in that an outer diameter of the stop lug (1313) is smaller than that of the trigger lug (1312).

7. The maintenance safety apparatus (100) according to claim 4, characterized in that the linkage control assembly (130) further comprises:

a base plate (134) on which a first guide groove (1341) is provided, the second bracket (133) linearly moving up and down along the first guide groove (1341); and a tension spring (135) configured to hang the second bracket (133) on the base plate (134).

8. The maintenance safety apparatus (100) according to claim 7, characterized in that the base plate (134) is provided with a second guide groove (1342), a stop pin (142) of the linkage locking assembly (140) is capable of linearly running up and down along the second guide groove (1342) and capable of stopping the rotation of the stop lug (1313) of the linkage engagement plate (131) in the second direction when the stop pin (142) moves to the bottom of the second guide groove (1342).

9. The maintenance safety apparatus (100) according to claim 8, characterized in that when the stop pin (142) moves to the top of the second guide groove (1342), the stopping of the stop lug (1313) of the linkage engagement plate (131) by the stop pin (142) is released.

10. The maintenance safety apparatus (100) according to claim 4, characterized in that the first bracket (132) is provided with a slotted hole (1321), and during the locking operation, the restoring lug (1311) is partially placed in the slotted hole (1321) and pulls the first bracket (132) upward.

11. The maintenance safety apparatus (100) according to claim 2, characterized in that the linkage engagement plate (131) is fixed to a lock cylinder shaft (122) of the door lock device (120), and a first torsion spring (136) is provided between the door lock device (120) and the linkage engagement plate (131).

12. The maintenance safety apparatus (100) according to claim 2, characterized in that the linkage locking assembly (140) is located substantially above the linkage control assembly (130).

13. The maintenance safety apparatus (100) according to claim 12, characterized in that the linkage locking assembly (140) comprises:

a striking bow (144) which is provided on the landing door (10) and two ends of which are rotatable about a rotating shaft (145);

a third bracket (141);

a stop pin (142) provided on the third bracket (141); and a connecting rod (143) having a first end connected to the striking bow (144) and a second end connected to the third bracket (141), wherein when the landing door (10) is opened or during the opening operation of the landing door (10), the striking bow (144) is driven to a first position and in turn drives the stop pin (142) to a lower end position to lock the linkage engagement plate (131) in a position corresponding to the first state; and when the landing door (10) is closed or during the closing operation of the landing door (10), the striking bow (144) is driven to a second position and in turn drives the stop pin (142) to an upper end position to unlock the linkage engagement plate (131).

14. The maintenance safety apparatus (100) according to claim 13, characterized in that a second torsion spring (146) is provided on the rotating shaft (145) in a manner corresponding to the striking bow (144), which is used for rotating the striking bow (144) from the second position to the first position.

15. The maintenance safety apparatus (100) according to claim 10, characterized in that the linkage locking assembly (140) comprises a roller (147) on the landing door (10), and when the landing door (10) is closed or during the closing operation of the landing door (10), the roller (147) rolls relative to the striking bow (144) and urges the striking bow (144) to rotate to the second position.

16. The maintenance safety apparatus (100) according to claim 1, characterized in that the safety switch is a bistable switch.

17. The maintenance safety apparatus (100) according to claim 1, characterized in that the door lock device (120) is placed on the landing door (10), and the safety switch (110) is also placed on the landing door.

18. The maintenance safety apparatus (100) according to claim 2, characterized in that the linkage engagement plate (131) of the linkage control assembly (130) is integrated with the door lock device (120).

19. A method for operating a maintenance safety apparatus (100), comprising:

performing an unlocking operation in a manual mode on a door lock device (120) while driving a linkage control assembly (130) to perform actuation, to enable a safety switch (110) to be placed in a first state, wherein the corresponding elevator system is enabled to be in a maintenance operating mode when the safety switch (110) is placed in the first state;

opening a landing door (10), wherein when the landing door (10) is opened or during the opening operation of the landing door (10), the linkage control assembly (130) is placed in an actuation locked state by a linkage locking assembly;

closing the landing door (10) after a staff goes out from a hoistway, wherein when the landing door (10) is closed or during the closing operation of the landing door (10), the linkage control assembly (130) is placed in an actuation unlocked state by the linkage locking assembly; and performing a locking operation in a manual mode on the door lock device (120) while driving the linkage control assembly (130) to perform actuation, to enable the safety switch (110) to be placed in the second state, wherein the elevator system is enabled to be in a normal operating mode when the safety switch (110) is placed in the second state.

20. The operation method according to claim 19, characterized in that the unlocking operation and the locking operation are carried out by rotating a key (121) of the door lock device (120) in different directions, respectively.

21. The operation method according to claim 20, characterized in that performing the unlocking operation and the locking operation, when the key (121) is rotated, a linkage engagement plate (131) of the linkage control assembly (130) is rotated in linkage therewith.

22. The operation method according to claim 21, characterized in that performing the unlocking operation, a trigger lug (1312) of the linkage engagement plate (131) is rotated in linkage with the key (121) in a first direction and is depressed against a second bracket (133) of the linkage control assembly (130), so that the rotation of the trigger lug (1312) is transformed into upward and downward linear movements, and the second bracket (133) is depressed against a first bracket (132) of the linkage control assembly (130) and triggers the safety switch (110) via the first bracket (132) to transform from the second state to the first state; and performing the locking operation, a restoring lug (1311) of the linkage engagement plate (131) is rotated in linkage with the key (121) in a second direction opposite to the first direction and pulls the first bracket (132), and in turn restores the safety switch (110) from the first state to the second state.

23. The operation method according to claim 22, characterized in that closing the landing door (10), when the landing door (10) is closed or during the closing operation of the landing door (10), the stopping of a stop lug (1313) of the linkage engagement plate (131) by the linkage locking assembly (140) is released, thereby enabling the linkage control assembly (130) to be placed in the actuation locked state.

24. The operation method according to claim 22, characterized in that opening the landing door (10), when the landing door (10) is opened or during the opening operation of the landing door (10), the linkage locking assembly (140) stops the stop lug (1313) of the linkage engagement plate (131) to lock the rotation of the linkage engagement plate (131) at least in the second direction, thereby enabling the linkage control assembly (130) to be placed in the actuation unlocked state.

25. The operation method according to claim 21, characterized in that opening the landing door (10), when the landing door (10) is opened or during the opening operation of the landing door (10), a striking bow (144) of the linkage locking assembly (140) is driven to a first position and in turn drives a stop pin (142) of the linkage locking assembly (140) to a lower end position to lock the linkage engagement plate (131) in a position corresponding to the first state; and when the landing door (10) is closed or during the closing operation of the landing door (10), the striking bow (144) is driven to a second position and in turn drives the stop pin (142) to an upper end position to unlock the linkage engagement plate (131).

26. An elevator system, characterized in that a landing door (100) thereof is provided with a maintenance safety apparatus (100) as claimed in claim 1.

* * * * *